United States Patent [19]

Barry

[11] 4,302,159

[45] Nov. 24, 1981

[54] AMBIENT AIR TIMING DEVICE

[75] Inventor: William L. Barry, Houston, Tex.

[73] Assignee: Vapor Corporation, Chicago, Ill.

[21] Appl. No.: 68,728

[22] Filed: Aug. 22, 1979

[51] Int. Cl.[3] ..... F04B 49/00

[52] U.S. Cl. ..... 417/46; 91/337; 417/403

[58] Field of Search ..... 417/401-404, 417/210, 12, 46; 91/289, 284, 330, 337, 443, 463

[56] References Cited

U.S. PATENT DOCUMENTS

| | | | |
|---|---|---|---|
| 1,617,516 | 2/1927 | Farquhar | 91/284 |
| 2,551,292 | 9/1953 | Cornett | 91/284 |
| 2,569,213 | 9/1951 | Adams | 91/284 X |
| 2,861,144 | 11/1958 | Favre | 91/443 X |
| 3,387,563 | 6/1968 | Williams et al. | 91/284 |
| 3,846,049 | 11/1974 | Douglas | 417/404 |
| 4,030,857 | 6/1977 | Smith | 417/46 |
| 4,082,481 | 4/1978 | Fenne | 417/403 |
| 4,147,179 | 4/1979 | Miura | 91/443 X |
| 4,161,308 | 7/1979 | Bell et al. | 91/337 X |

*Primary Examiner*—Carlton R. Croyle
*Assistant Examiner*—Edward Look
*Attorney, Agent, or Firm*—Francis J. Lidd

[57] ABSTRACT

An air timing device for a high pressure reciprocating injector pump 14 employing a piston or movable wall 50 and orifice 48 combination that is mechanically reset on the suction stroke of the pump includes a bellows 42 defining a variable volume chamber 44 including at least one movable wall. An adjustable orifice 46 in parallel with a check valve is defined in the chamber to provide adjustable flow out of the chamber and full flow through the check valve into the chamber. The wall is connected to a piston 18 of the reciprocating pump by an arm 38 that is fixedly secured to the piston and slideably secured to the wall. A selector valve 62 is also included for directing supply fluid to a selected side of the pump piston to reciprocate the pump. The valve includes a spool valve connected to the wall by a second arm. The fluid within the chamber defined by the bellows may be employed in a closed system wherein the fluid is exhausted from the chamber to an external chamber for reuse during the next stroke of the pump or in an alternative embodiment, the fluid may be exhausted to the atmosphere.

8 Claims, 3 Drawing Figures

AMBIENT AIR TIMING DEVICE

BACKGROUND OF THE INVENTION

1. Field of the Invention

The device of the present invention relates to a new and improved timing device for reciprocating pumps.

2. Description of the Prior Art

Known pump timer combinations typically utilize the power fluid as opposed to ambient fluid as the timing medium. Other prior art timing devices include an electrical magnetic coil to arm or reset the timer and provide output through an electrical contact. Disadvantages of these prior art devices include a need for electric power, with attendant hazards when used in explosive atmospheres, structural complexity and susceptibility to break down due to contamination of electrical components, and particularly fluid flow circuits.

Typical timing devices are illustrated, for example, in U.S. Pat. No. 3,012,541. This device employs an external electrical signal to actuate time delayed operation. Another apparatus disclosed in U.S. Pat. No. 3,160,486 employs a timer that is sealed by o-rings that is subject to substantial wear resulting in undesirable down time for repair. In addition, the system disclosed in this patent employs four timing compartments and an accumulator vessel greatly increasing the complexity of the timer and the probability of break down. The system of the '486 patent also includes several orifices through which the media must flow resulting in change in operating characteristics due to orifice contamination and further increasing the likelihood of down time for servicing.

SUMMARY OF THE INVENTION

An object of the present invention is to provide a fluid timer for a reciprocating pump.

It is a further object of the present invention to provide a fluid delay mechanism that generates a concurrent cyclic action followed by a predetermined dwell period employing only a single ambient orifice and no orifices in the high pressure supply source.

A further object of the present invention is to provide a fluid delay mechanism for a reciprocating pump that provides a cyclic function of the pump which occurs at the end of a prescribable delay or dwell period of the timer.

A still further object of the present invention is to provide a more repeatable timer by use of a precise mechanically actuated timer.

Also to provide a more repeatable timer by eliminating sliding seals with varying friction and varying leakage rates instead employing a bellows with zero contact friction and zero leakage rates.

Still another object of the present invention is to provide a timer for a reciprocating pump that employs a single orifice apart from the supply media that is filtered to a high degree to eliminate outside contaminates.

The present invention is directed to a new and improved fluid timing device for a fluid delay mechanism that generates a cyclic action followed by a preselected dwell period to serve as a timer for actuation of a reciprocating pump that includes a piston. The timer assembly includes a variable volume chamber defined by a bellows including a movable wall. The movable wall is connected by a link or arm to a piston rod connected to the pump piston. The arm is rigidly connected to the piston rod and slideably connected to the wall.

A supply fluid directional control valve is also included and is defined by a housing in which is mounted a spool valve. The spool valve is actuable to direct supply fluid to a selected side of the piston thereby actuating the pump. The spool valve is coupled to the wall of the timing device by a second arm that is rigidly connected to the wall and slideably connected to the spool valve.

Upon the directional control valve directing fluid to the pump to commence a suction stroke, the piston rod is moved relative to the wall until engaging the connection of the second arm on the wall whereafter the remaining portion of the stroke functions to move the wall expanding the volume of the chamber within the bellows. This movement of the wall is opposed by a resilient member such as a spring.

Upon engagement of the first arm with the second arm, the second arm is also moved until engaging a stop on the spool of the control valve. This engagement simultaneously moves the spool to a second position which marks the completion of the suction stroke of the pump. The movement of the spool valve also reverses the flow of supply fluid to the opposite side of the piston of the pump thus commencing reciprocation of the piston by a compression stroke.

As the compression stroke of the pump begins, the first arm slides away from the first stop and the timer spring is free to move the wall toward the original position compressing the fluid within the bellows. An orifice is defined in the bellows so as to meter the flow of fluid out of the chamber thereby controlling the rate of return of the wall.

As the wall returns to its original position, the second arm slides relative to the spool of the directional control valve until engaging a third stop. Further movement of the wall results in movement of the spool valve to its original position reversing the flow of supply fluid and repeating the pumping cycle. In the embodiment disclosed, the orifice may be filtered and be in fluid communication with ambient fluid. In an alternative embodiment, the orifice may be included in a closed system wherein it is in fluid communication with a fluid tank.

It is of the utmost significance to provide the first orifice free power media for a delay action reciprocating mechanism.

Pump power supply orifices have been eliminated by mechanically interconnecting the three basic systems defined as the pumping chamber, the timing device and the media directional valve. In this way, pilot signals with small passageways interconnecting the various systems have been eliminated. Further, orifices that control pump rate, typically either upstream in the pump media or downstream in the exhaust media, have been eliminated by an independent action timing device containing a single ambient orifice.

The timing device of the present invention is entirely independent of the operation of the pump piston in the timing mode and will shift the directional control valve in the absence of a supply gas signal, such as if the supply lines to the directional control valve becomes frozen. In addition, through the employment of a bellows, contacting surfaces which create variable values of friction are eliminated and a positive air type seal that allows no variability due to leakage of the sliding seals such as found in the prior art is also provided. Also, the present timer employs the same quantity of fluid within the bellows for each stroke of the pump thus resulting in increased timing accuracy and thus increased metering accuracy. As will be determined from the detailed description of the present invention, the device of the present invention includes only three basic moving assemblies, the bellows, the bellows actuator, and the directional control valve, thus simplifying the typical prior art system.

BRIEF DESCRIPTION OF THE DRAWINGS

The above and other objects and advantages and novel features of the present invention will become apparent from the following detailed description of preferred embodiments of the invention illustrated in the accompanying drawings wherein.

DETAILED DESCRIPTION OF THE PREFERRED EMBODIMENT

Figure 1:
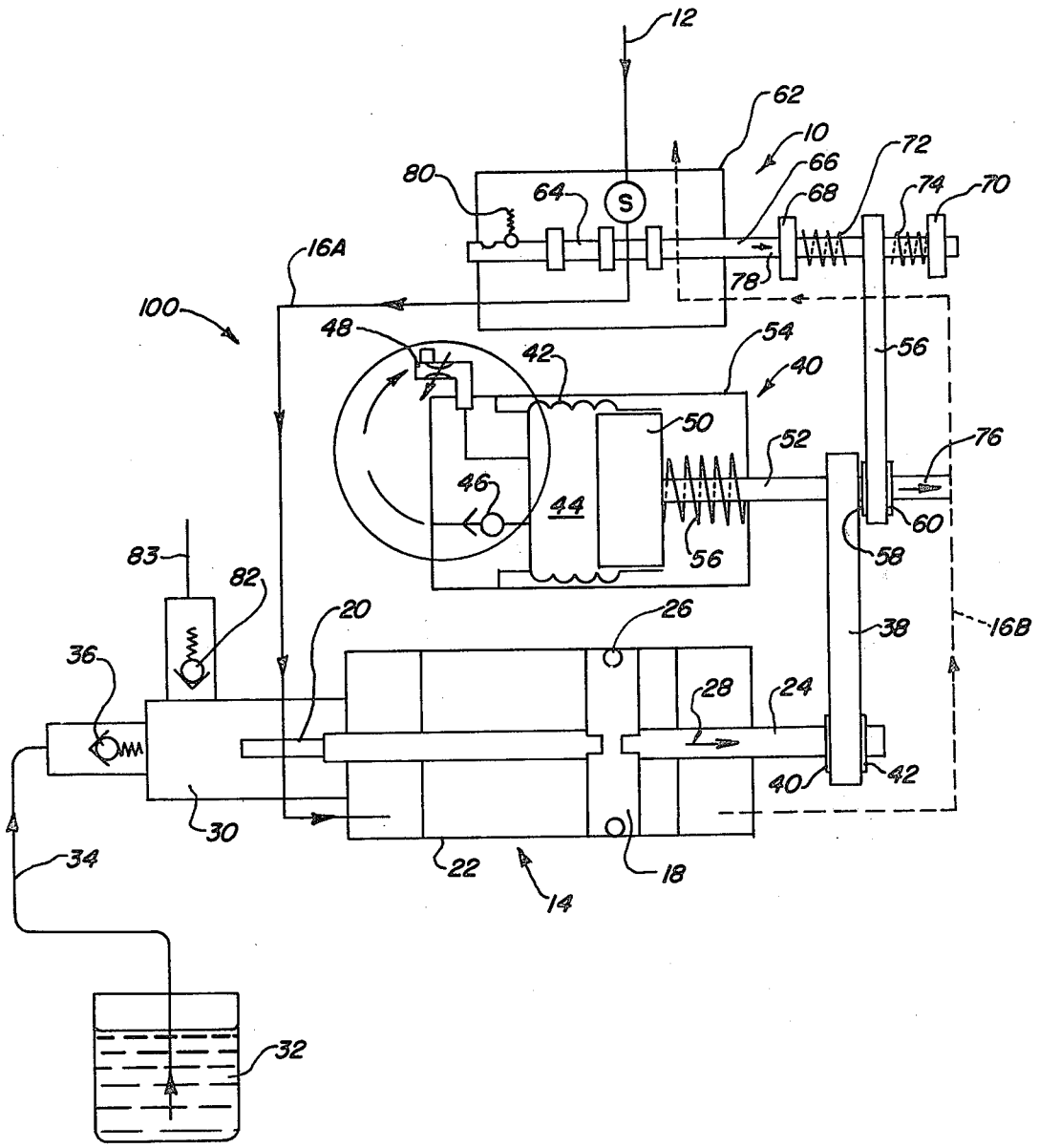
FIG. 1 is a schematic diagram of the circuit of the present invention illustrating the suction stroke of the reciprocating pump.
Figure 2:
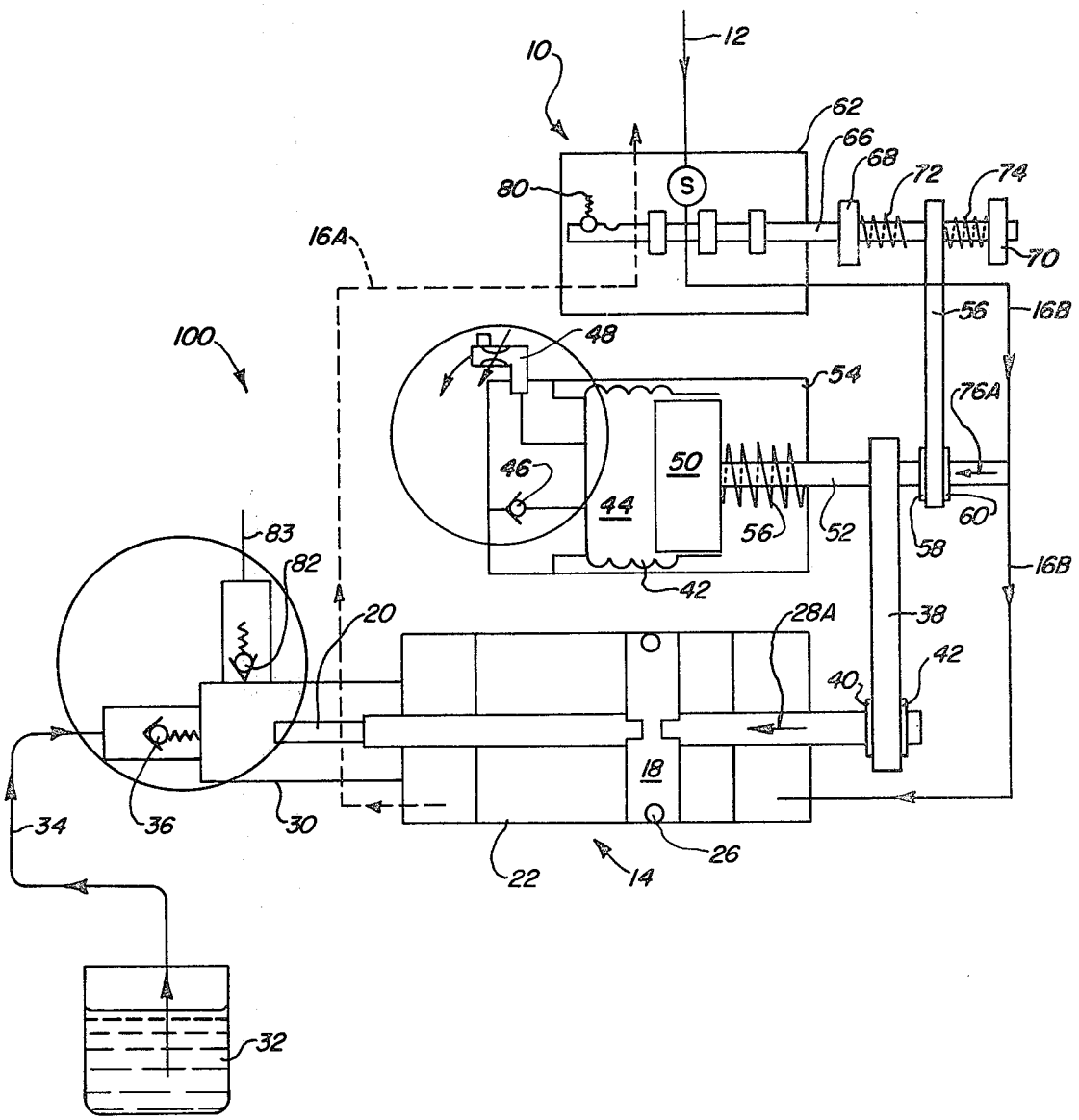
FIG. 2 is a schematic diagram of the circuit of the present invention wherein the pump is actuated to commence its compression stroke and the timing device is in operation.
Figure 3:
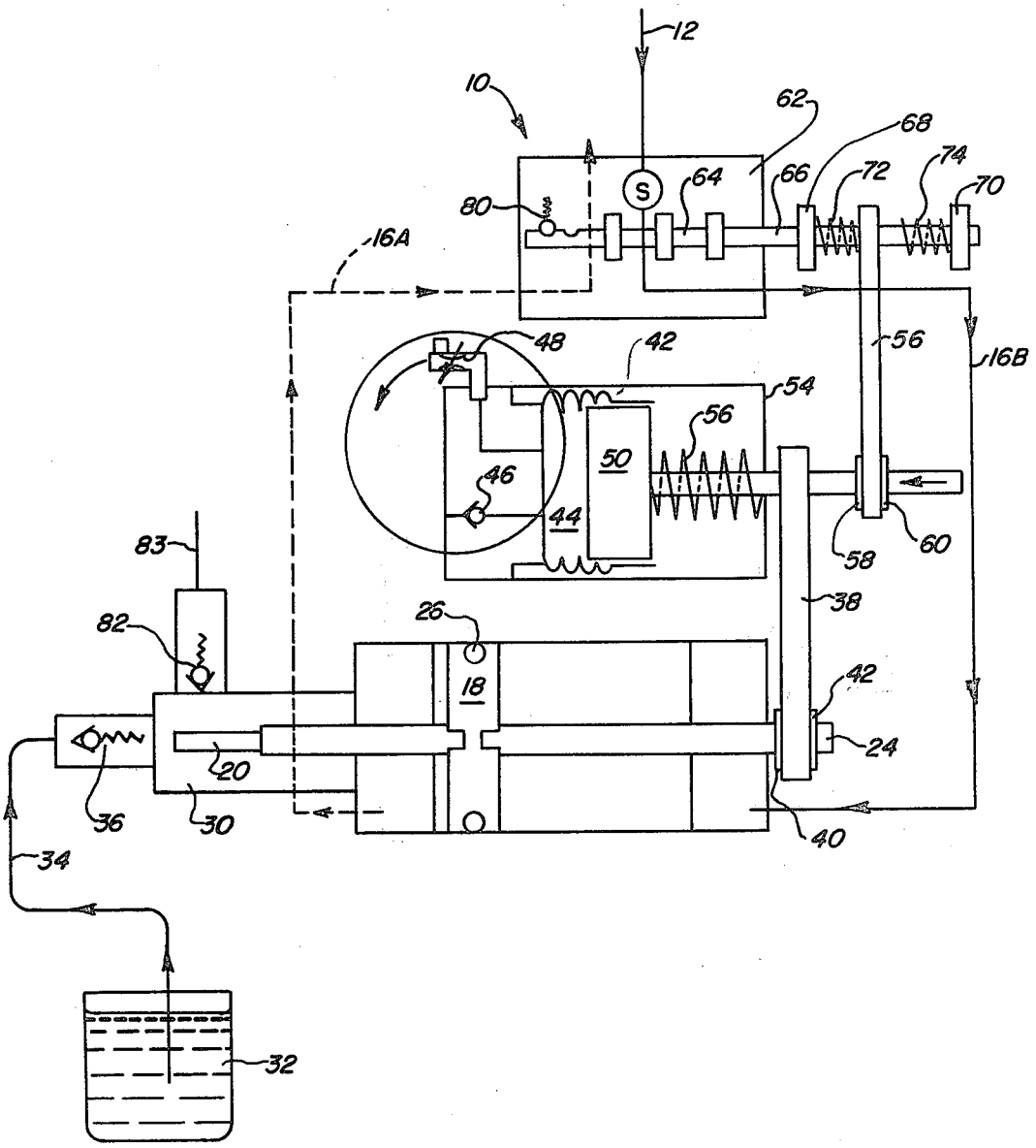
FIG. 3 is a schematic diagram of the circuit of the present invention at the completion of the compression stroke of the pump during the timed delay period and just prior to the actuation of the control valve to repeat the cycle.

Referring to the drawings, FIGS. 1, 2, and 3 correspond respectively to modes 1, 2, and 3 of the circuit of the present invention. The circuit 100 of the present invention includes a directional control valve generally designated by the reference numeral 10 for directing supply fluid such as pressurized air from a source conduit 12 to a selected side of a pump or power cylinder generally designated by the reference numeral 14 by way of a conduit 16A or 16B. The pump 14 includes a piston 18 with a fluid plunger 20 secured at one side of the piston 18 extending through a first end of the housing 22 of the pump 14 and a piston rod 24 extending through a second end of the housing 22. The piston 18 slides within the housing 22 and fluid leakage thereacross is prevented by an o-ring 26. Introduction of supply fluid through conduit 16A causes movement of the piston 18 in the direction of the arrow 28 to withdraw the fluid plunger 20 out of a fluid head chamber 30 resulting in a suction or vacuum stroke. Chamber 30 is in fluid communication with a reservoir 32 by way of a conduit 34 and a one-way valve 36.

The piston rod 24 is fixedly secured to a first end of a first index arm 38 by retaining rings 40. Accordingly, during the suction stroke portion of the cycle described above, the index arm 38 moves with the piston rod 24 in the direction of the arrow 28. A second end of the index arm 38 is slideably connected to a timing device generally designated by the reference numeral 40.

The timing device 40 includes a bellows 42 defining a variable volume chamber 44 that in the embodiment illustrated, is in fluid communication with the atmosphere through an open check valve 46 and, in part, through a variable metering valve 48. The chamber 44 is defined at one end by a movable wall or timer piston 50 to which is secured a timer rod 52. The bellows 42 and the wall 50 are positioned within a timer housing 54 that includes an aperture through which the timer rod 52 extends. A spring 56 is mounted within the housing 54 encircling the rod 52 and engaging the wall 50 at one end and the inside of the housing 54 at the other end.

The indexing arm 38 is slidingly connected to the timing device 40 by extending the timing rod 52 through an aperture defined in the second end of the indexing arm 38. Fixedly mounted on the timer rod 52 is a second indexing arm 56 that is secured to the timer rod 52 by retaining rings 58 and 60.

In mode 1 of the circuit 1, the piston 18 moves in the direction of the arrow 28 due to the introduction of pressurized fluid to the power cylinder 22 by way of the conduit 16A. The second end of the first indexing arm 38 slides relative to the timer rod 52 until engaging the retainer ring 58. Thereafter, the timer rod 52 and the second indexing arm 56 move with the first indexing 38 until completion of the stroke of the pump 14.

During mode 1, the second indexing arm 56 serves to actuate the directional control valve 10. The directional control valve 10 includes a housing 62 within which is mounted a spool valve 64. Spool valve 64 includes a valve rod 66 extending out of the housing 62. First 68 and second 70 stop collars are secured to the valve rod 66 and between them is slidably mounted the upper end of the indexing arm 56. More specifically, the rod 66 extends through an aperture defined in the upper end of the timer index arm 56.

Encircling the rod at a location between the stop collar 68 and the upper end of the indexing arm 56 is a first spring 72. In a like manner, a second spring 74 is positioned between the second stop collar 70 and the upper end of the indexing arm 56.

Having briefly described the structure of the circuit of the present invention, the operation in the first mode will now be described. Upon the initiation of the supply of high pressurized fluid through the directional control valve 10 as previously described, pressurized fluid is introduced into one end of the pump 14 by the conduit 16A to actuate and move the power piston cylinder 18 within the housing 22 of the pump 14. This movement in the direction of the arrow 28 moves the index arm 38 which slides the upper end of the index arm 38 along the timer rod 52 until engaging the retaining ring 58. Once this occurs, the timer rod 52 is moved in the direction of the arrow 76 under the influence of the piston 18. This action also moves the wall 50 against the bias of the spring 56 in the direction of the arrow 76. At the same time, the timer indexing arm 56 is moved in the direction of the arrow 76 against the bias of the spring 74. The size of the spring 74 is selected such that the force developed by the spring 74 at the completion of the stroke of the piston 18 is of sufficient magnitude to move the valve rod 66 in the direction of the arrow 78 to overcome a detent mechanism 80 that holds the spool valve 64. The spool valve 64 is thus moved to a second position whereupon the detent mechanism 80 again engages the spool valve 64 maintaining it in this second position.

The movement of the spool valve 64 to the second position terminates the flow of supply fluid through conduit 16A and directs the flow of fluid through the conduit 16B while connecting the conduit 16A to exhaust or a reservoir. Simultaneous with this action, the timer piston or wall 50 has been moved by the rod 52 against the bias of the spring 56 storing a supply of energy equivalent to the deflection caused by the overall travel of the piston 18. Due to the volume displaced by the timer piston 50, a partial vacuum is obtained in the bellows chamber 44. This vacuum creates a flow through the open check valve 56 and in part through the metering orifice 58 into the evacuated space in the chamber 44. In addition, during the movement of the piston 18 in the first mode, the plunger 20 has been withdrawn out of chamber 30 thereby drawing fluid into the chamber 30 from the reservoir 32.

The second mode is now commenced. In the second mode as illustrated in FIG. 2, pressurized fluid acts against the piston 18 moving it in the direction of the arrow 28A that is opposite to the direction of movement of the piston 18 in the first mode. As the piston 18 moves in the direction of the arrow 28A, the fluid ahead of the piston 18 is exhausted through the conduit 16A. This movement of the piston 18 also moves the plunger 20 into the chamber 30 resulting in a compression stroke forcing or discharging fluid through a one-way valve 82 and into a fluid line 83.

As the piston 18 moves, the index arm 38 slides along the timing rod 52 out of engagement of the retaining ring 58. As this occurs, the spring 56 functions to bias the timing piston or wall 50 in the direction of the arrow 76A and against the force created by the fluid within the bellow chamber 44.

This commences mode 3 or the timing mode of the timing device 40. As the timer rod 52 moves in the direction of the arrow 76A under the influence of the spring 56, the timer index arm 56 engages the spring 72 transferring force through the arm 56 to the valve rod 66. As the timer piston 50 moves, the fluid within the bellow chamber 44 is compressed resulting in increased pressure above the ambient pressure that closes the check valve 46 and results in metering of the fluid in the chamber 44 through the metering orifice 48. The size of the orifice 48 may be adjusted and the spring rate of the piston 56 may also be preselected such that a time delay occurs until the timer index arm 56 sufficiently compresses the spring 72 to develop a force to overcome the holding action of the detent mechanism 80. Once this occurs the spool valve 64 is moved to the first or original position as illustrated in FIG. 1 and the cycle is repeated.

By completing the cycle of modes 1–3, a pumping action is provided whereupon in mode 1 the plunger 20 is withdrawn from the chamber 30 resulting in a suction drawing fluid from the reservoir 32 through the one-way valve 36 into the chamber 30. During mode 2, the plunger 20 is extended into the chamber 30 resulting in a discharge or compressive stroke pumping fluid into the circuit. The timing device 40 allows sufficient delay before repeating this cycle to allow completion of the discharge or compressive stroke and assures a more accurate metering function.

In an alternative embodiment, the timer check valve 46 and the metering orifice 48 may be connected to a closed system as opposed to the atmosphere in the open system described. In this embodiment, a fixed volume of working fluid is provided for the bellows that minimizes debris that could clog either the one-way check valve 46 or the orifice 48.

An analytical approach has been developed to select the volume capacity of the bellows 42 and the bellows chamber 44 in order to assure a metering of a sufficient quantity of fluid at a repeatable rate. Thus, the volume of the bellows 42 can be accurately determined.

While only two embodiments of the present invention have been shown, it will be understood that various changes and modifications may occur to those skilled in the art and it is contemplated by the appended claims to cover all such changes and modifications as are found in the true spirit and scope of the present invention.

What is claimed as new and desired to be secured by Letters Patent of the United States is:

1. A delay mechanism for developing a cyclic action followed by a predetermined delay in a pump or the like comprising an enclosed chamber including a movable wall for varying the volume of said chamber, variable flow rate means to allow variable flow of fluid into and out of said chamber, coupling means for coupling said wall to said pump, to allow said pump to move said wall to a first position, biasing means for biasing said wall to a second position, said coupling means includes an arm slideably secured to said wall and fixed to said pump to allow at least partial operation of said pump without movement of said wall; and a directional control valve for directing supply fluid to said pump for actuation thereof and a second arm fixed to said wall and slideably secured to said control valve to control the actuation thereof in response to movement of said wall wherein the control valve action is not immediate.

2. The mechanism set forth in claim 1 wherein said chamber comprises a bellows.

3. The mechanism set forth in claim 1 wherein said flow rate means comprises a metering valve.

4. The delay mechanism set forth in claim 1 wherein said pump includes a piston and a piston rod secured thereto, said wall includes a second rod secured thereto, said arm being fixedly secured to said piston rod and slideably mounted on said second rod.

5. A fluid timer for a reciprocating pump wherein said pump includes a housing, a reciprocating piston therein and a piston rod secured to said piston, said timer comprising, an expansible chamber defined in part by a movable wall, connecting means for connecting said piston rod to said wall, first means for fixedly securing said connecting means to said piston rod, second means for securing said connecting means to said wall to allow predetermined movement of said piston rod prior to moving said wall to a first position, and supply fluid directional control means for directing supply fluid to said pump to a selected side of said piston to reciprocate said pump, said fluid control means includes a housing and a spool valve slideably mounted therein with a valve rod secured thereto, and second connecting means fixedly secured to said wall and slideably mounted on said valve rod wherein the action of said spool valve in response to movement of said second connecting means is not immediate.

6. The timer claimed in claim 5 further comprising resilient means for moving said wall from said first position to a second position.

7. The timer claimed in claim 5 further comprising means for controlling the rate of fluid flow into and out of said chamber.

8. The timer claimed in claim 5 wherein said expansible chamber comprises a bellows.

* * * * *